United States Patent [19]

Battista

[11] 3,996,822

[45] Dec. 14, 1976

[54] SPRING BIASED MOVABLE JAW TOOL

[75] Inventor: Angelo T. Battista, Worcester, Mass.

[73] Assignee: Parker Manufacturing Co., Worcester, Mass.

[22] Filed: Feb. 4, 1976

[21] Appl. No.: 655,093

[52] U.S. Cl. ..... 81/367; 81/417; 30/261

[51] Int. Cl.[2] ..... B25B 7/12

[58] Field of Search ..... 81/368–380, 81/417, 427; 267/79; 30/261, 252, 271, 268; 403/381, 331

[56] References Cited

UNITED STATES PATENTS

| | | | |
|---|---|---|---|
| 2,489,895 | 11/1949 | Kash | 81/380 |
| 2,591,925 | 4/1952 | Erbe | 403/331 |

*Primary Examiner*—James L. Jones, Jr.

*Attorney, Agent, or Firm*—Norman S. Blodgett; Gerry A. Blodgett

[57] ABSTRACT

A tool including a handle, a movable jaw pivotally mounted on the handle, and a spring which biases the movable jaw. The connection between the spring and the movable jaw involves a keyhole cut in the jaw and a neck and an enlarged head on the end of the spring which head can lock into the keyhole.

10 Claims, 7 Drawing Figures

SPRING BIASED MOVABLE JAW TOOL

BACKGROUND OF THE INVENTION

Many types of tools have a movable element which is pivotally mounted to another element and biased by a spring. One such tool is the so-called "locking plier". A locking plier functions in a manner similar to regular pliers except that a locking plier is adapted to be fixed in any desired position. In the normal locking plier construction, a handle is provided with a stationary jaw and a movable jaw. The movable jaw is pivotally mounted to the handle and biased away from the stationary jaw by a spring which is connected between the movable jaw and the handle. In order to provide sufficient support for the movable element, it is desirable to extend the handle so that it closely encloses a large portion of the movable jaw. Since there is very little clearance between the movable jaw sides and the surrounding portions of the handle, any method of connecting the spring to the movable jaw cannot extend outwardly of the sides of the jaw. The solution to this problem has been to stamp a portion of the movable jaw to form a narrow tab, to pierce a hole in the tab, and then to thread a coil of the spring through the hole. While this form of connection provides a suitable solution to the problem, it does involve three steps which make up a tangible part of the cost of manufacturing. The two operations of stamping and piercing involve a high-risk hand operation and expensive machine time, while the threading of the spring wire through the hole involves a separate and expensive hand operation. These and other difficulties experienced by the prior art devices have been obviated in a novel manner by the present invention.

It is, therefore, an outstanding object of the invention to provide a tool in which the number and complexity of manufacturing steps is reduced and thereby the manufacturing costs.

Another object of this invention is the provision of a tool whose manufacture involves fewer dangerous or complex human operations.

With these and other objects in view, as will be apparent to those skilled in the art, the invention resides in the combination of parts set forth in the specification and covered by the claims appended hereto.

SUMMARY OF THE INVENTION

This invention involves a tool having a main body, a movable jaw mounted for pivotal motion on the main body and a spring connected to the movable jaw and biasing it. The connection between the movable jaw and the spring involves a keyhole punched through the movable jaw parallel to the axis about which the jaw pivots and an enlarged head on the end of the spring. The keyhole consists of an aperture spaced from the edge of the jaw and of a passage communicating between the edge and the aperture. The head of the spring resides in the aperture and is too large to fit through the passage.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
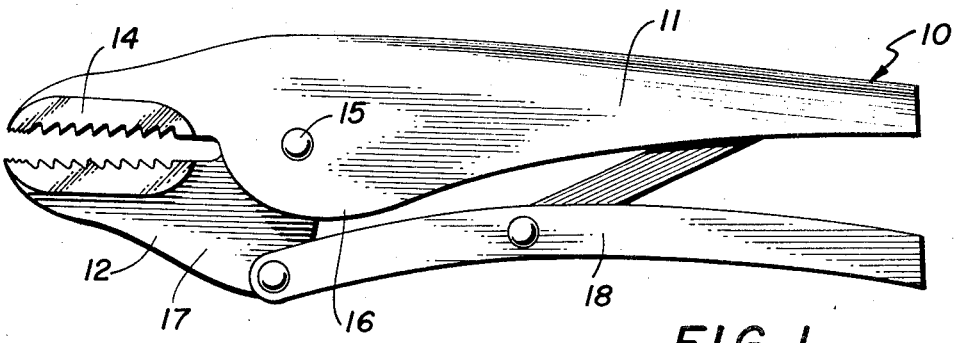
FIG. 1 is an elevation view of a tool embodying the principles of the present invention.

Referring first to FIG. 1, in which are best shown the general features of the present invention, the tool, designated generally by the numeral 10, is shown as including a main body or handle 11, and a movable jaw 12. A stationary jaw 14 is attached to the handle 11 and opposes the movable jaw 12. The movable jaw 12 is pivotally mounted to the handle 11 for motion about an axis 15. Side plates 16 of the handle 11 extend downward adjacent each side of the movable jaw 12 and cover substantial portions of each face surface 17 of the movable jaw 12. A closing and locking system 18 is connected between the moving jaw 12 and the handle 11, and functions in the conventional manner of locking pliers.

Figure 2:
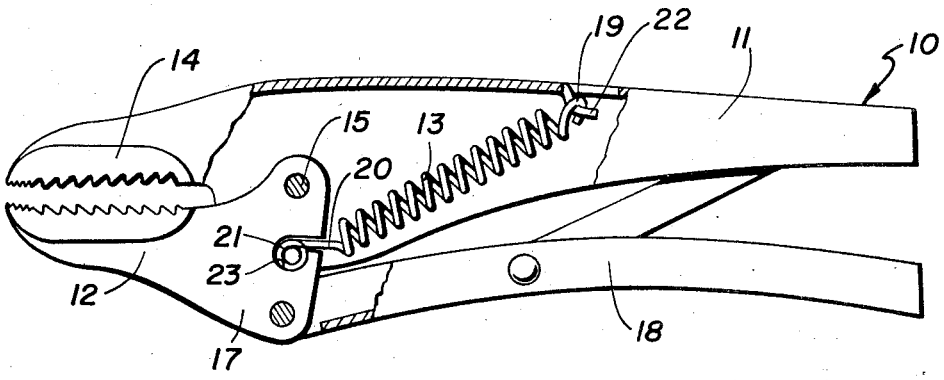
FIG. 2 is an elevation view in partial section of the tool shown in FIG. 1.

Referring to FIG. 2 in which a substantial portion of the handle 11 including the side plate 16 has been cut away, it can be seen that the movable jaw 12 is biased away from the stationary jaw 14 by a spring 13. In the preferred embodiment, the spring 13 is a coil spring having a coil 19 at one end and a neck 20 and enlarged head 21 at the other end. The coil 19 is secured around a tab 22 formed in the handle 11, while the head 21 is secured in a keyhole 23 formed in the movable jaw 12.

Figure 3:
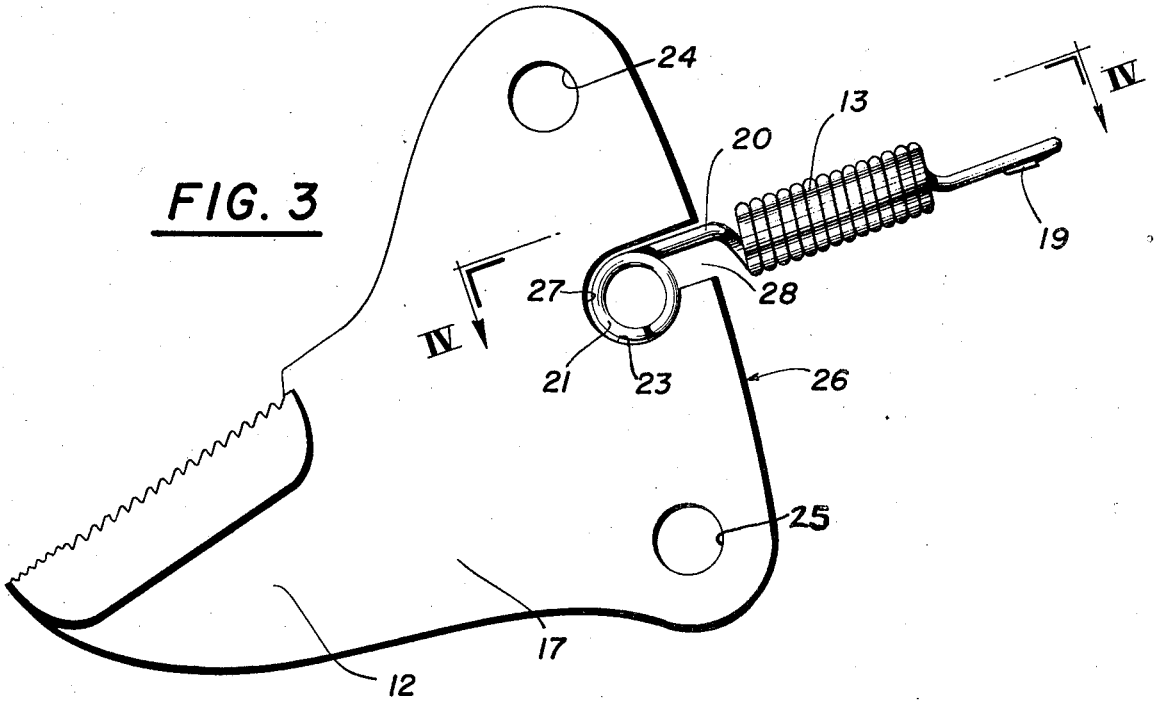
FIG. 3 is a detailed view of a portion of the tool shown in FIG. 2.

FIG. 3 shows a detailed view of the movable jaw 12, the spring 13 and the connection between the two. The movable jaw 12 is a plate-like element having a generally flat face surface 17 on each side. The jaw 12 is generally triangular in shape having openings 24 and 25 which pass through the jaw 12 in opposed corners and are suitable for cooperating with the other elements of the tool to form pivotal connections. Between the openings 24 and 25 is keyhole 23 which passes through the jaw 12 and opens through edge surface 26, the edge surface being adjacent and generally perpendicular to the face surfaces 17. In the manufacture of this embodiment, the openings 24 and 25 and the keyhole 23 would be formed in a single step using an appropriate piercing tool.

The keyhole 23 may be viewed as the union of a cylindrical aperture 27 piercing through the jaw 12, perpendicular to the face surface 17 and parallel to and spaced from the edge surface 26, and a passage 28 which pierces through the jaw 12 and communicates the aperture 27 with the edge surface 26. The important aspect of the keyhole 23 is that the aperture 27 is larger than the passage 28, so that an object which nearly fills the aperture will not fit through the passage. More precisely stated, the aperture 27 has a first critical diameter which is its largest diameter parallel to the face surface 17 and the edge surface 26. Likewise, the passage 28 has a second critical diameter which is its smallest diameter parallel to the face surface 17 and the edge surface 26. If the second critical diameter is smaller than the first critical diameter, and the generatrices of the walls of the keyhole 23 are all parallel, an object having a third critical diameter (maximum diameter) which is shorter than the first critical diameter and longer than the second critical diameter, may fit in the aperture 27 but will not fit through the passage 28 as long as the third critical diameter is maintained parallel to the first and second critical diameter.

In the preferred shape of the keyhole, the aperture 27 is a right circular cylinder with its axis perpendicular to the face surfaces 16 and the passage is defined by two walls each of which is prependicular to the edge surface 26 and the face surface 17. One wall is tangential to the aperture 27 and the other is coplanar with the axis of the aperture 27. Thus, the keyhole 23 is a cylinder in the mathematical sense that the walls are defined by a generatrix which is continuously moved parallel to an axis. In the resulting keyhole structure, the passage 28 has a uniform cross-section parallel to the edge surface 26. The aperture 27 has a first critical diameter which is exactly twice the second critical diameter of the passage 28.

The result of the above geometric analysis is that if a spring 13 is provided with a neck 20 which is narrower than the passage 28, that is it has a fourth critical diameter (maximum diameter) less than the second critical diameter so that the neck 20 fits through the passage 28, and the enlarged head 21 has at least one third critical diameter which is larger than the second critical diameter of the passage 28, then the enlarged head 21 will not fit through the passage 28. Two factors should be recognized however. The above geometric relationships will not keep the enlarged head 21 from exiting axially out the ends of the aperture. To prevent this and thereby allow a secure connection between the spring and the jaw 12, a retainer system must be provided. In the preferred embodiment the retainer system is simply side plates 16 which, in addition to their other functions, cover the ends of the keyhole 23 at all times during the normal operation of the tool 10.

The second problem is that the enlarged head 21 may well have a diameter perpendicular to the length of the spring, which diameter is smaller than the second critical diameter of the passage 28. If the enlarged head 21 is allowed to rotate about the long axis of the neck and this smaller diameter becomes parallel to the second critical diameter of the passage 28, the enlarged head will fit through the passage and end the connection between the spring and the jaw 12. To prevent this, a maintainer system must be provided to assure that a third critical diameter greater than the second critical diameter of the passage is always maintained parallel to the second critical diameter. The maintaining system of the preferred embodiment involves forming the enlarged head 21 into a cylinder which is of diameter only slightly smaller than the first critical diameter of the aperture 27. If the axial length of the head 21 is at least half of its diameter, a practical clearance can be left between the head and the wall of the aperture 27 while maintaining the axis of the head and the aperture sufficiently parallel to stop the head from rotating and fitting through the passage 28.

Figure 4:
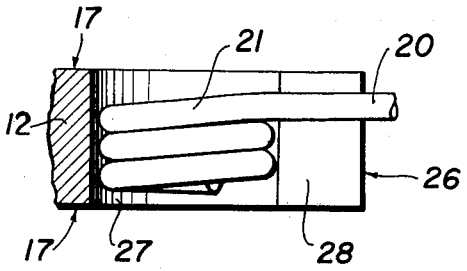
FIG. 4 is a sectional view taken along line IV—IV of FIG. 3.

The formation of the head into a cylinder is preferably accomplished by forming at least three coils on the end of the spring as shown in FIG. 4. The head 21 can be slid into the aperture 27 through the open end through the face surface 17. The form-locking arrangement which maintains the enlarged head 21 so that it will not fit through the passage 28 and the retaining function of the side plates 16 which continuously cover the openings through the face surfaces 17 and retain the enlarged head 21 in the aperture 27, result in a permanent and secure connection between the spring and the movable jaw 12.

Figure 5:
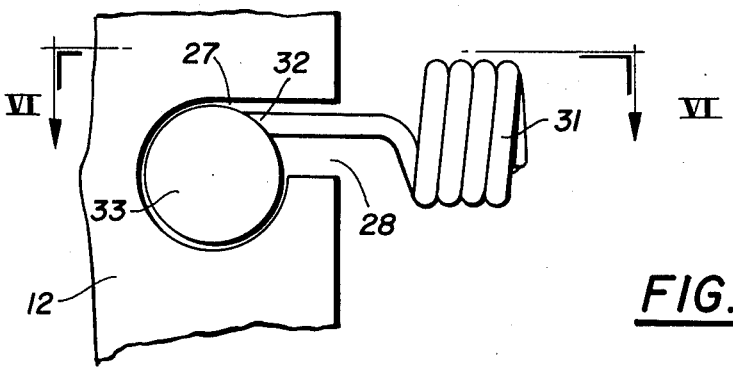
FIG. 5 is a detailed view of an alternative of the structure shown in FIG. 3.
Figure 6:
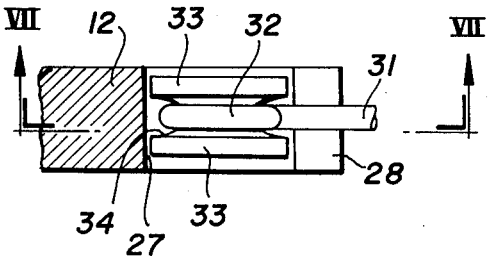
FIG. 6 is a sectional view taken along line VI—VI of FIG. 5.
Figure 7:
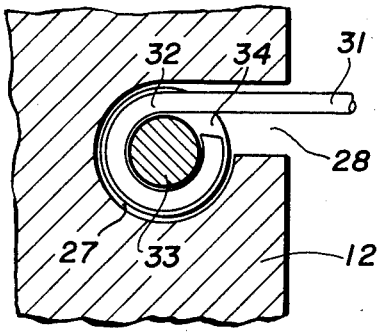
FIG. 7 is a sectional view taken along line VII—VII of FIG. 6.

An alternative method of forming a head 21 into a cylinder is shown in FIGS. 5, 6, and 7. In this approach, a single coil 32 of a spring 31 is wrapped around a separate cylindrical button 33. The button has a central, peripheral groove 34 in which the coil 32 sits. The button is of slightly smaller diameter than the first critical diameter of the aperture 27 and is slightly shorter in axial length than aperture 27. In operation, this button arrangement works in a very similar fashion to the coil arrangement discussed above.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A tool, comprising
a. a main body,
b. a movable jaw mounted on the main body for pivotal motion about an axis, the jaw having
i. a generally flat face surface perpendicular to the axis,
ii. an edge surface adjacent the face surface,
iii. a keyhole passing through the face surface, the keyhole including an aperture which opens on the face surface but is spaced from the edge surface, and a passage which extends through the face surface and the edge surface and connects the aperture with the edge surface,
c. a wire spring adapted to bias the jaw, the spring having at one end a neck and a head connected to the neck, the head being of such size and shape that it will fit into the aperture but that it will not fit through the passage when it is in at least one position with respect to the aperture, and the neck being of such size and shape as to fit through the passage, the head residing in the aperture and the neck residing in the passage,
d. a maintainer system adapted to keep the head in a position such that it cannot fit through the passage, and
e. a retainer system adapted to keep the head from exiting the aperture at the face surface.

2. A tool, comprising
a. a main body,
b. a movable jaw mounted on the main body for pivotal motion about an axis, the jaw having
i. a generally flat face surface perpendicular to the axis,
ii. an edge surface adjacent the face surface,
iii. a keyhole passing through the face surface, the keyhole including an aperture which passes through the face surface but is spaced from the edge surface, and has a first critical diameter generally parallel to the edge surface and face surface, and a passage which extends through the face surface and the edge surface and connects the aperture with the edge surface, the passage having a second critical diameter parallel to the face surface and the edge surface and smaller than the first critical diameter, c. a wire spring adapted to bias the jaw, the spring having at one end a neck and a head connected to the neck, the head having at least one third critical diameter smaller than the first but larger than the second critical diameter, so that, when the head is oriented with a third critical diameter parallel to the first and second diameters, the head will not pass through the passage, and the neck having a fourth critical diameter smaller than the second critical diameter, the head residing in the aperture and the neck residing in the passage, d. a maintainer system adapted to keep a third critical diameter parallel to the first and second critical diameter, and e. a retainer system adapted to keep the head from exiting the aperture at the face surface.

3. A tool as recited in claim 2, wherein the keyhole passes entirely through the jaw.

4. A tool as recited in claim 2, wherein the passage has a rectangular cross-section parallel to the edge surface.

5. A tool as recited in claim 2, wherein the aperture is cylindrical.

6. A tool as recited in claim 5, wherein the head of the spring is cylindrically shaped with a third critical diameter of an amount less than the first critical diameter and a length of an amount with respect to the length of the aperture that the axis of the aperture and head are held parallel so that the relative shapes of the aperture and the head form the retaining system.

7. A tool as recited in claim 6, wherein the head is formed of a plurality of coils of wire.

8. A tool as recited in claim 6, wherein the head is formed of a single coil of wire wrapped around a separate button which extends axially to both sides of the coil of wire.

9. A tool as recited in claim 6, wherein the head is formed by connecting the spring to a separate button.

10. A tool as recited in claim 2, wherein the handle forms a portion of the retainer system by continuously covering the opening of the aperture through the face surface.

* * * * *